US006401629B1

(12) United States Patent
Brunooghe

(10) Patent No.: US 6,401,629 B1
(45) Date of Patent: Jun. 11, 2002

(54) DOOR FOR RAILROAD CAR

(75) Inventor: Damien Brunooghe, Azay-sur-Cher (FR)

(73) Assignee: Faiveley Transport, Saint Denis (FR)

( * ) Notice: Subject to any disclaimer, the term of this patent is extended or adjusted under 35 U.S.C. 154(b) by 0 days.

(21) Appl. No.: 09/459,127

(22) Filed: Dec. 10, 1999

(51) Int. Cl.[7] ..... B61D 17/00

(52) U.S. Cl. ..... 105/341; 105/333; 105/329.1; 105/343; 105/427; 105/437

(58) Field of Search ..... 104/28, 30; 105/329.1, 105/331, 332, 333, 339, 341, 343, 426, 427, 439, 430, 431, 435, 437, 438, 425, 436, 450; 280/166

(56) References Cited

U.S. PATENT DOCUMENTS 5,070,794 A 12/1991 Kunst et al. ..... 105/435

*Primary Examiner*—Mark T. Le
(74) *Attorney, Agent, or Firm*—Nawrocki, Rooney & Sivertson P.A.

(57) ABSTRACT

The invention relates to a door for a railway vehicle, intended for a door opening having steps, on which there are provided a platform and a threshold above the steps to permit disembarking onto a railway platform situated higher than the steps. The invention is characterised in that the door includes a single leaf and a mechanism provided for controlling the unlocking of the threshold member with respect to the door, when the platform is in the position of use and the door opens, so that this threshold member remains in place opposite the edge of the platform in the position of use and the edge of the railway platform.

17 Claims, 8 Drawing Sheets

DOOR FOR RAILROAD CAR

Figure 1:
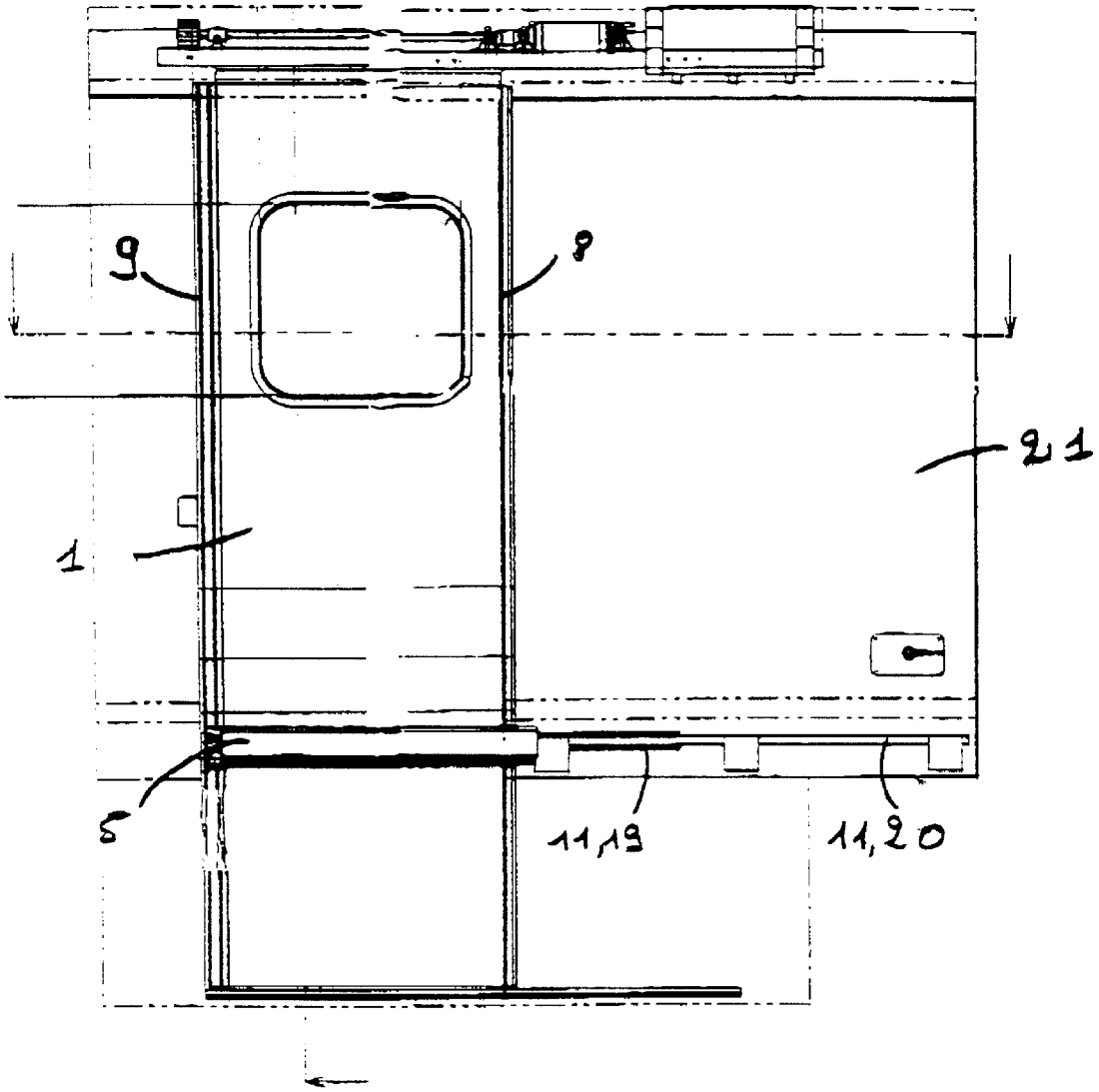

The invention relates to a railway vehicle door, intended for a door opening with steps, on which there are provided a platform and a movable threshold above the steps so as to permit disembarking onto a railway platform situated higher than the steps.

Such railway vehicle doors are already known, having a platform and threshold arranged above steps.

The document U.S. Pat. No. 5,070,794 describes a railway vehicle door for a door opening to which the passengers gain access by means of a set of steps arranged inside the vehicle. This door comprises two leaves, bottom and top, sliding with respect to each other, and connected by locking means. The door is mounted so as to slide between a closed position and an open position. A platform is fixed so as to be articulated on an axis substantially perpendicular to the door and is situated substantially in the horizontal plane of the top of the steps, the said platform being able to be moved from a free retracted position with respect to the said horizontal plane and a position of use in which it is situated in the said horizontal plane. A threshold member projects with respect to the external face of the door in order to fill in at least part of the space lying between the edge of the platform, in the position of use, and the edge of the railway platform. This threshold member is an integral part of the bottom leaf.

The aim of the invention is to produce a door having a simplified structure compared with the door described above.

To that end, the invention concerns a railway vehicle door consisting of a single leaf having a threshold member making it possible to reduce the space between the platform and the railway platform, when the platform is in the position of use.

The door according to the invention thus has the same advantages as the doors used in the prior art.

The invention is characterised in that the door consists of a single leaf and in that means are provided for controlling the unlocking of the threshold member with respect to the door, when the platform is in the position of use and the door opens, so that this threshold member remains in place opposite said edge of the platform in the position of use and the edge of the railway platform.

According to a preferred embodiment of the invention, the threshold member is partly embedded in a recess formed in the door.

The vehicle body comprises, close to the edge of the door opening opposite to the direction of opening of the door, means for supporting the end of the threshold member, when the door is open.

These means for supporting the end of the threshold element comprise, for example, rollers carried by the said end of the threshold member and abutment surfaces receiving the said rollers fixed to the vehicle body.

In a first variant of the preferred embodiment, the guidance means between the threshold member and the door comprise:

- a rail fixed to the threshold member extending in the longitudinal direction of the said threshold member and projecting from the end of this member in the direction of opening of the door,
- and a slide on which the rail slides, the slide being fixed to the body and having a length at least equal to the length of the threshold member.

In a second variant of the preferred embodiment, the guidance means between the threshold member and the door comprise:

- a rail fixed to the door, extending in the longitudinal direction of the threshold member and projecting from the end of the door on the same side as the direction of opening of the latter with a length at least equal to the length of the threshold member,
- and a slide fixed to the threshold member on which the rail slides, the length of the slide being substantially identical to that of the rail when the door is closed.

In the two variants, when the platform is in the position of use and the door opens, the threshold member remains in place opposite the said edge of the platform in the position of use and the edge of the railway platform.

Other particularities and advantages of the invention will also emerge from the following description.

Figure 2:
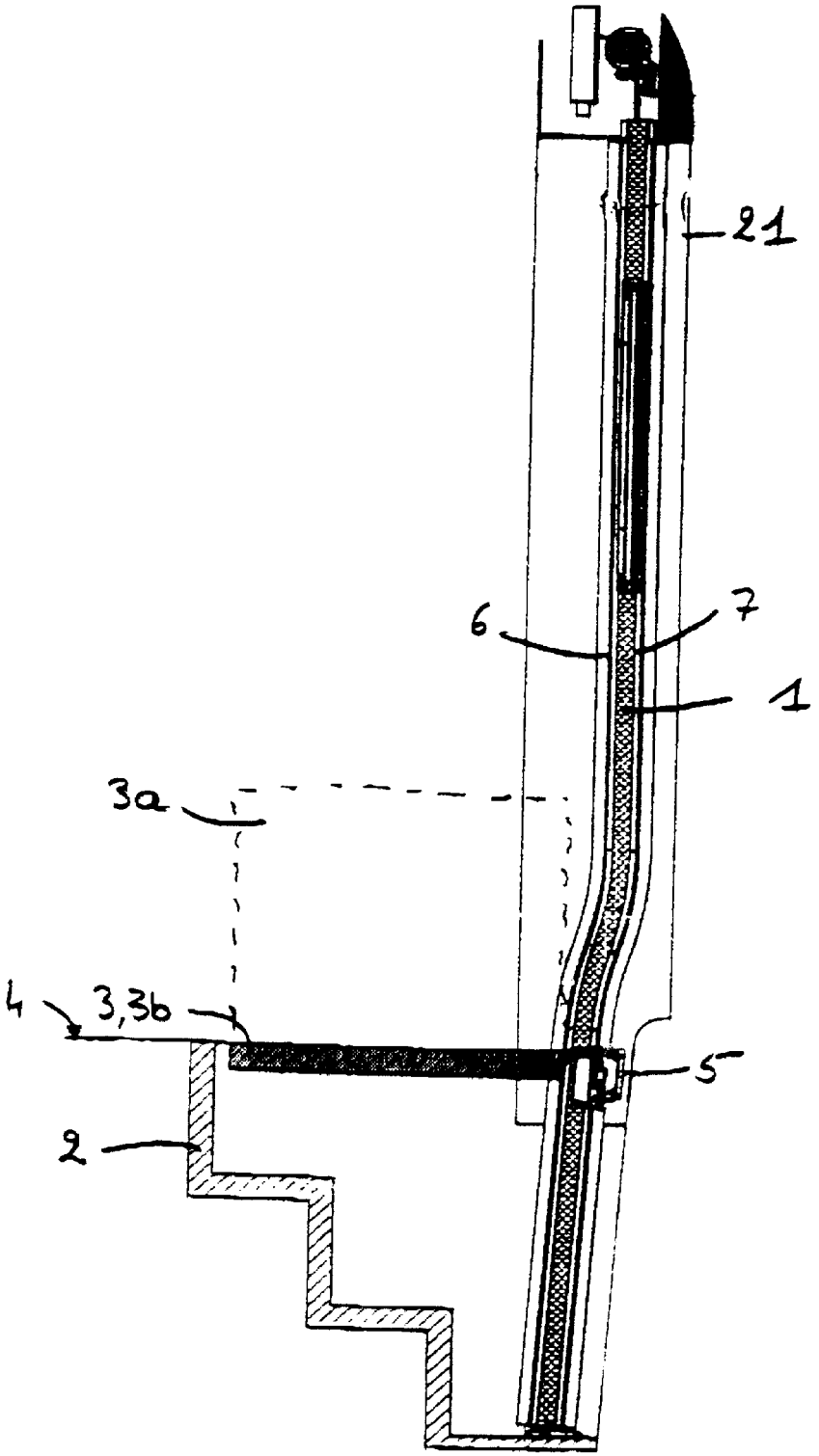
Figure 3:
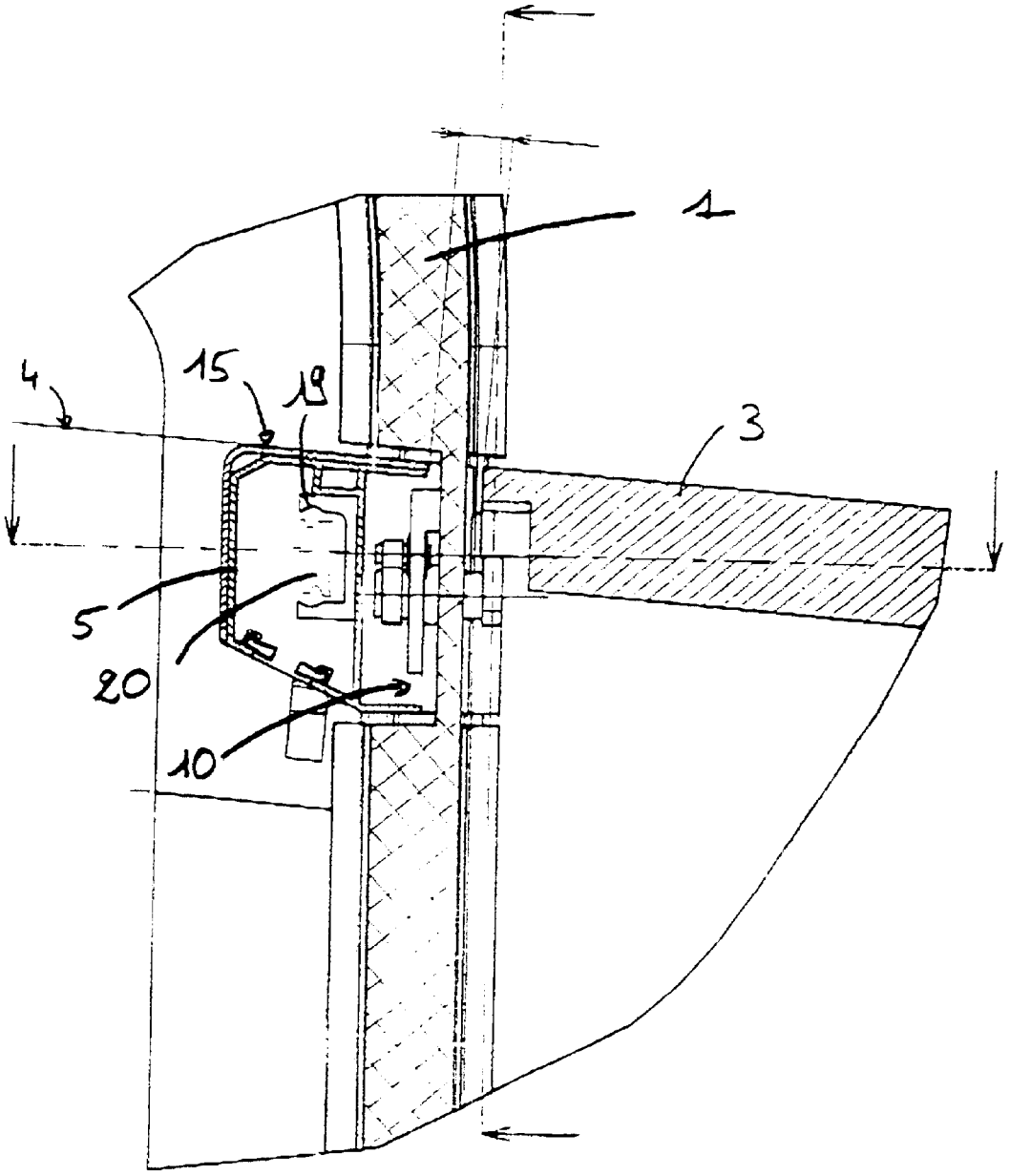
Figure 4:
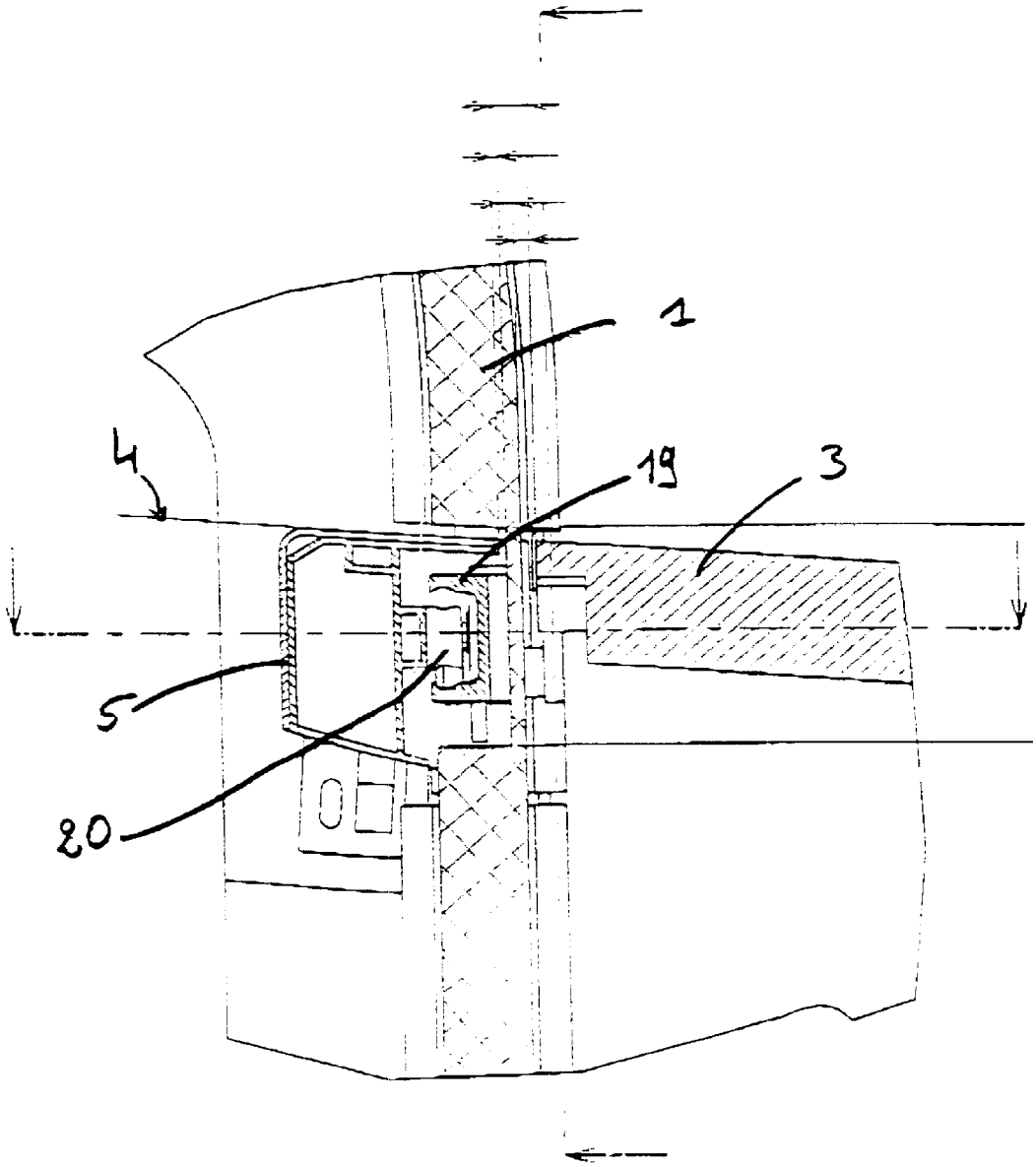
Figure 5:
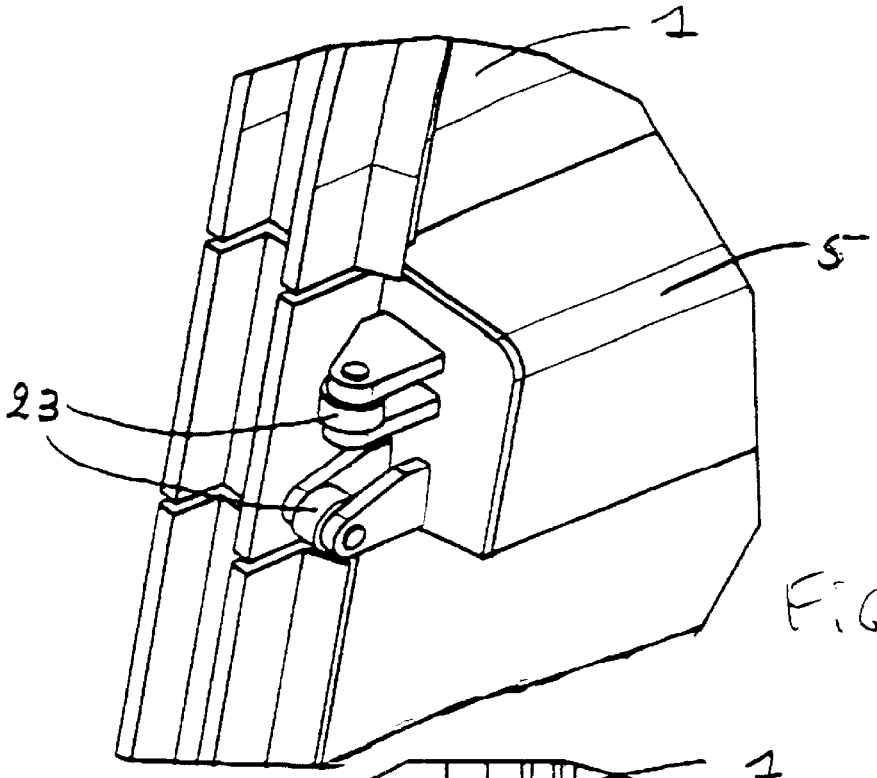
Figure 6:
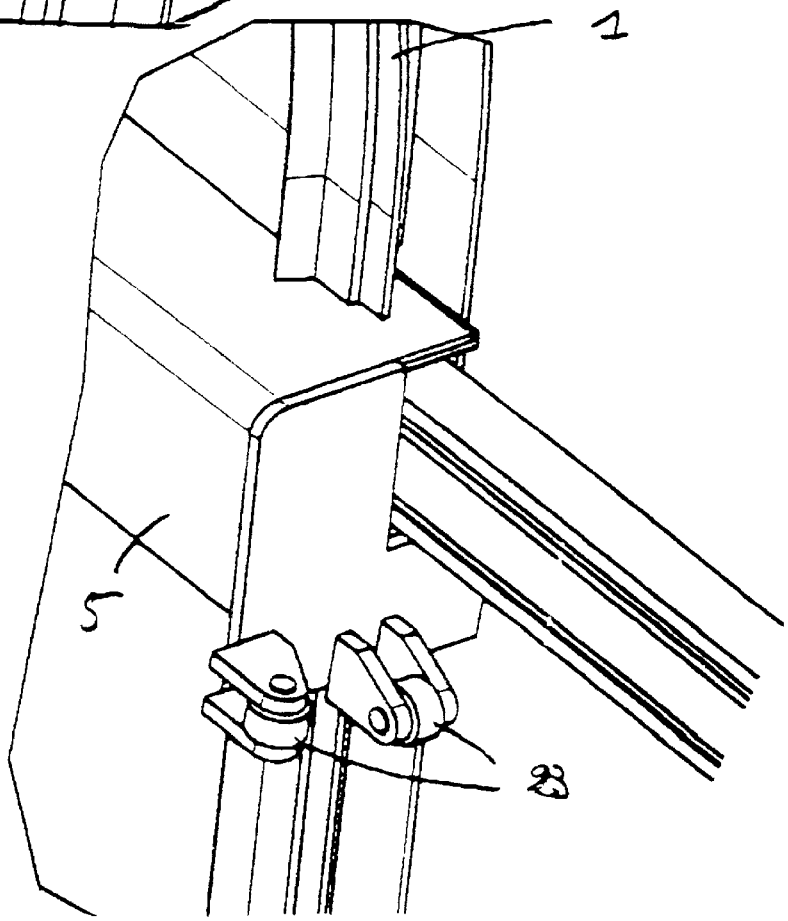
Figure 7:
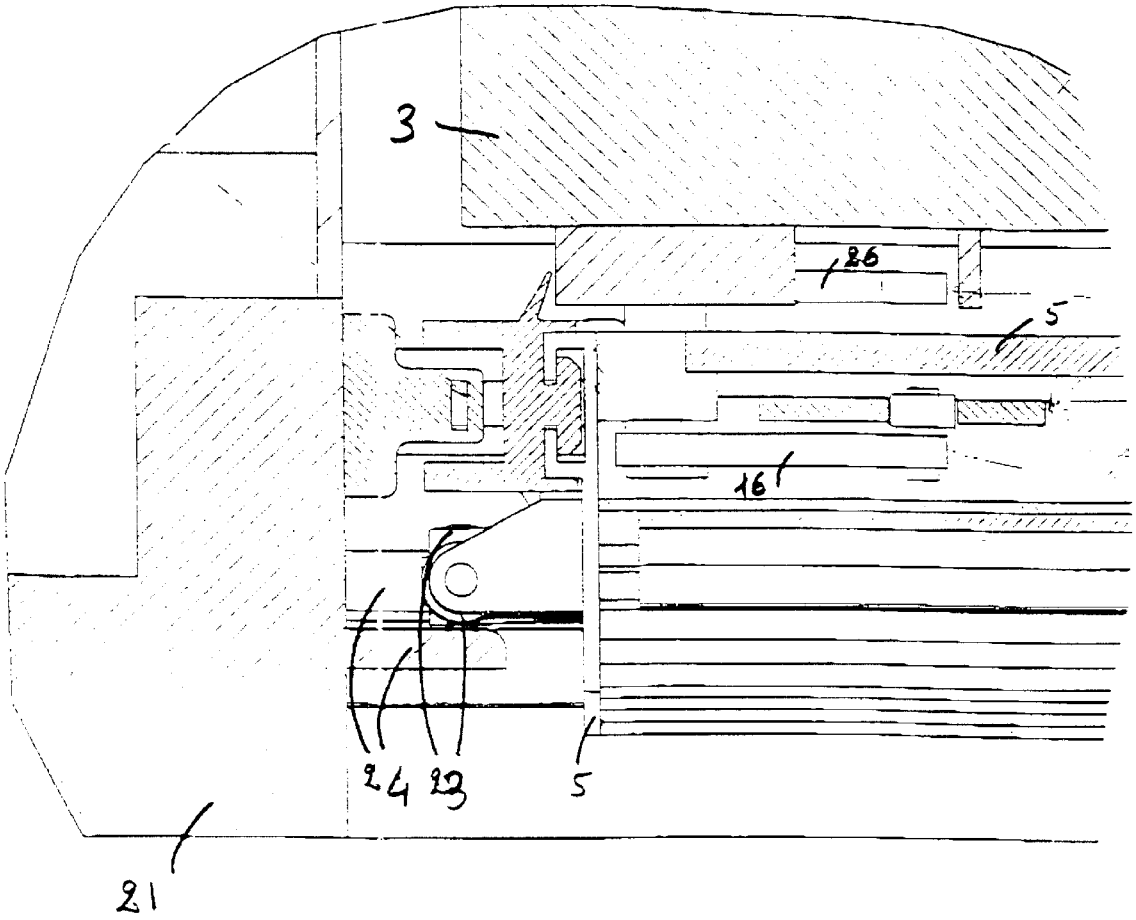
Figure 8:
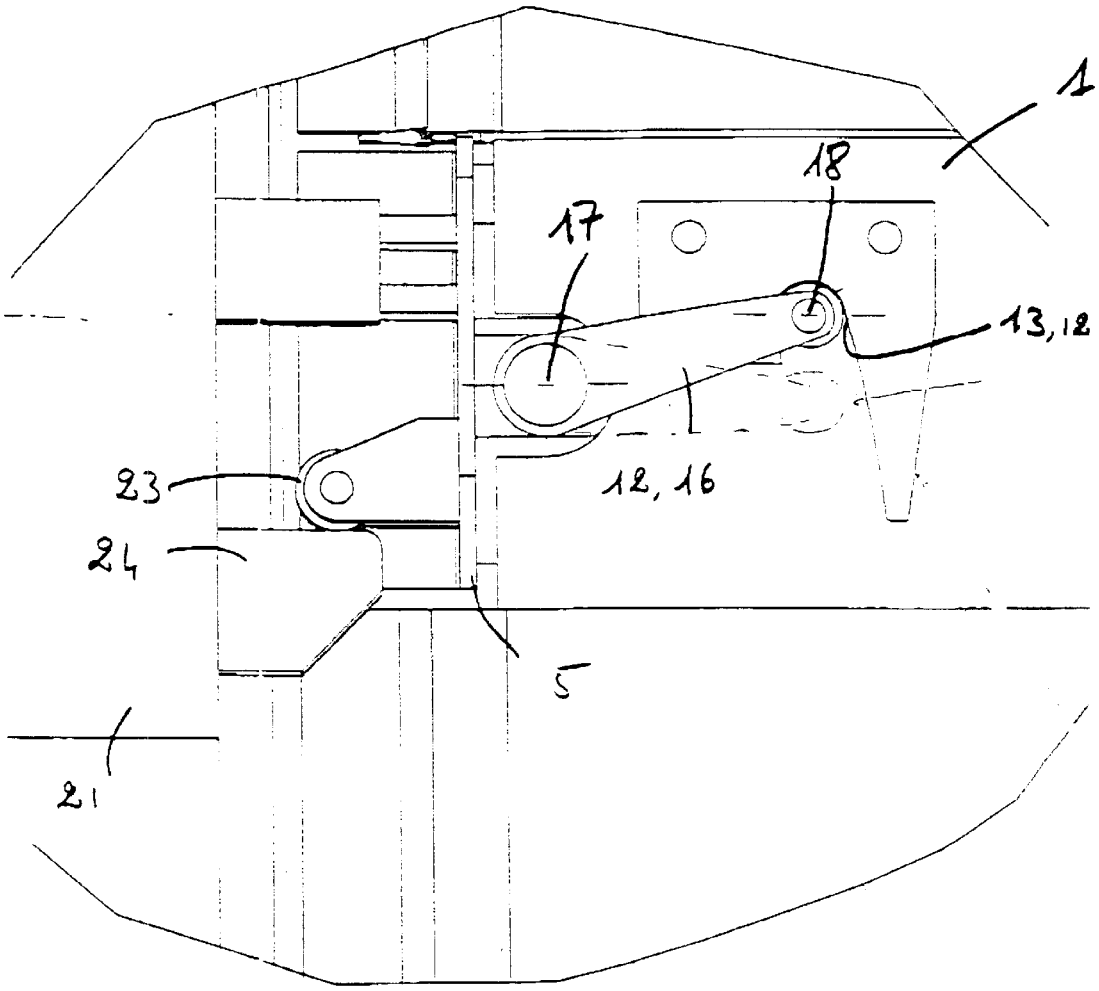
Figure 9:
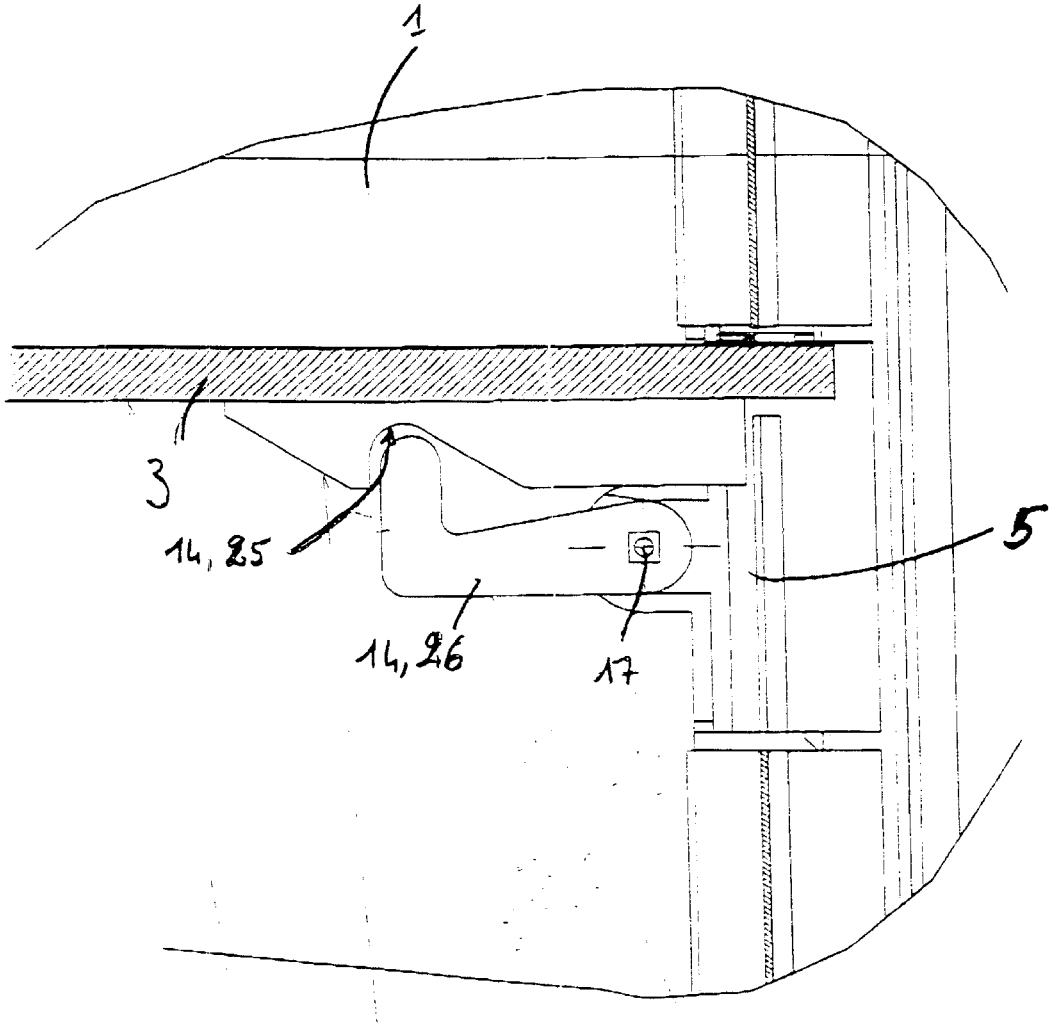

In the accompanying drawings given by way of non-limitative examples:

FIG. 1 is a view in plan and elevation of a door according to the invention mounted on a railway vehicle, FIG. 2 is a view in section of the door according to the invention and of the vehicle steps, the platform being in the use position, FIG. 3 is a view in section of the door and of the threshold member in a first embodiment, FIG. 4 is a view similar to FIG. 3 showing a second embodiment, FIG. 5 is a view in perspective of the end of the threshold member showing the support means carried by this end, FIG. 6 is a view similar to FIG. 5 showing another embodiment, FIG. 7 is a view in section to a larger scale of the threshold member in a horizontal plane showing the support means in abutment on abutment means on the vehicle body, FIG. 8 is a view in vertical section of the end of the threshold member showing the means cooperating with the platform in order to unlock the threshold element with respect to the door, FIG. 9 is a view in section showing the platform and the 1ever for unlocking the threshold member.

With reference to FIGS. 1 and 2, a railway vehicle door opening is provided with a door 1.

The passengers gain access to this opening by means of a set of steps 2 arranged inside the vehicle.

The door 1 is mounted so as to slide between a closed position and an open position.

A platform 3 is fixed so as to be articulated on an axis substantially perpendicular to the door 1 and situated substantially in the substantially horizontal plane 4 of the top of the steps 2.

The said platform 3 can be moved from a retracted position 3*a* free with respect to the said substantially horizontal plane and a position of use 3*b* in which it is situated in the said substantially horizontal plane 4.

In the free retracted position, the platform 3 is situated in a plane substantially perpendicular to the said horizontal plane. This position is depicted in broken lines in FIG. 2.

A threshold member 5 projects with respect to the external face of the door in order to fill in at least part of the space lying between the edge of the platform, in the position of use 3*b*, and the edge of the railway platform (not shown).

The door 1 is now described in detail with reference to FIGS. 1 to 4 and 7.

In the remainder of the description, an internal face 6 of the door 1 directed towards the inside of the vehicle and an external face 7 of the door 1 directed towards the outside of the vehicle are defined.

The door 1 consists of a single leaf. A first vertical edge 8 is situated on the side of the door situated in the direction of opening of the door 1, and a second vertical edge 9 is situated on the side of the door situated in the direction of closure of the door 1.

The door 1 has a recess 10 intended to receive the threshold member 5.

This recess 10 extends in the horizontal direction over the entire width of the external face 7 of the door.

Guidance means 11 are provided between the threshold member 5 and the door 1. These means 11 will be described in more detail in the remainder of the description.

Means 12 of locking the threshold member 5 with respect to the door 1 are provided on the said member 5 and the said door 1.

These locking means 12 comprise a cavity 13 situated on the external face 7 of the door, the opening of the cavity being directed towards the bottom of the door.

This cavity 13 is situated in the recess 10, close to the vertical edge 9.

The locking means 12 are unlocked by means 14 of unlocking the threshold member 5 with respect to the door 1, when the platform 3 is in the position of use 3*b* and the door opens, as described below.

The threshold member 5 is now described in detail with reference to FIGS. 3 to 9.

The threshold member 5 is partly embedded in the recess 10 formed in the door 1.

It has four faces extending in a horizontal direction. These four faces form substantially a hollow parallelepiped whose top face 15 is situated in the substantially horizontal plane 4 of the top of the steps 2, so that, when the platform 3 is in the position of use 3*b*, the top face 15 of the threshold member 5 is at the same level as the platform 3.

This top face 15 can have roughnesses or a non-slip covering to prevent the users from slipping.

The length of the threshold member 5 is substantially identical to the width of the door 1, or of the platform 3.

The threshold member 5 comprises means 12 of locking the door 1 which comprise a lever 16 fixed to the threshold member 5 so as to rotate with respect to an axis 17 substantially perpendicular to the plane of the door 1.

The end 18 of the lever 16 opposite to the axis 17 has a shape complementary to the cavity 13 situated on the door 1.

A torsion spring, not shown, situated on the axis of the lever 16 holds the latter in the raised position, so that the end 18 is held in the cavity 13. This position ensures the locking of the threshold member 5 with respect to the door 1, when the platform 3 is in position 3*a*.

The threshold member 5 is connected to the door 1 by the guidance means 11.

In a first variant of the embodiment, with reference to FIG. 3, the guidance means 11 comprise:

- a rail 19 fixed to the threshold member 5 extending in the longitudinal direction of the said threshold member and projecting from the end of this member 5 in the direction of opening of the door 1,
- and a slide 20 on which the rail 18 slides, the slide being fixed to the body 21 of the vehicle and having a length at least equal to the length of the threshold member 5.

The rail 19 has three faces whose cross-section is substantially in a U shape. The face corresponding to the bottom of the U-shaped section is situated in a vertical plane and fixed inside the threshold member 5, on the side situated close to the door 1.

The external shape of the slide 20 is substantially identical to the internal cavity of the rail 19, in order to ensure the sliding of the two pieces with respect to each other.

The slide 20 is rigidly fixed on the body 21, its length not exceeding that of the body.

Thus, when the platform 3 is in the retracted position 3*a*, the threshold member 5 being fixed to the door 1 by the locking means 12, it is driven with the door when it is opened.

When the platform 3 is in the position of use 3*b*, the locking means 12 of the threshold member 5 are unlocked so that the threshold member 5 is not driven by the door when it is opened. The threshold member is then held by the rail 19 bearing on the slide 20.

In a second variant of the embodiment, with reference to FIG. 4, the guidance means 11 comprise:

- a rail 19 fixed to the door 1, extending in the longitudinal direction of the threshold member 5 and projecting from the end of the door on the same side as the direction of the opening of the latter with a length at least equal to the length of the threshold member 5,
- and a slide 20 fixed to the threshold member 5, on which the rail 19 slides, the length of the slide 20 being substantially identical to that of the rail when the door is closed.

The shape of the rail 19 and that of the slide 20 are substantially identical to the shapes described for the first variant, only the length of these parts differ.

In this variant, when the platform 3 is in the position of use 3*b*, the threshold member 5 is then held by the slide 20, which bears on the part of the rail 19 situated on the door 1.

The vehicle body 21 comprises, close to the edge 9 of the door opening, opposite to the direction of opening of the door, means 22 for supporting the adjacent end of the threshold member 5, when the door 1 is open.

With reference to FIGS. 5 to 7, these means 22 comprise rollers 23 fixed to the said end of the threshold member 5 and abutment surfaces 24 fixed to the vehicle body 21, intended to receive the said rollers 23.

The axes of the rollers 23 are perpendicular to each other. Each roller 23 is supported by at least one abutment surface 24.

The abutment surfaces 24 of the two rollers 23 are therefore perpendicular to each other. They take up the forces exerted on the threshold member 5 when it is used by the passengers, ensuring the fixing of the threshold member. The forces to be withstood are for example vertical, due to the weight of the passengers, and in a direction substantially perpendicular to the plane of the door 1, due to the movement of the passengers.

In a variant depicted in FIG. 5, the two rollers 23 are disposed one above the other, the roller withstanding the vertical forces being in the lower position.

In another variant depicted in FIG. 6, the two rollers 23 are disposed alongside each other, the roller withstanding the horizontal forces being on the outside of the threshold member 5.

Additional rollers 23 and abutment surfaces 24 can be provided to increase the stabilisation of the threshold 5 still further during its use.

The unlocking means 14 are now detailed with reference to FIGS. 7 to 9.

These means 14 comprise a surface 25 fixed to the face of the platform 3 directed towards the step and a lever 26 rotatably fixed to the threshold member 5, the surface 25 of the platform coming to actuate the lever 26 when the platform in the position of use 3*b*.

The lever 26 is fixed to the lever 16 for locking the threshold member 5 with respect to the door 1, so that their rotation movements are identical.

Thus, as depicted in FIG. 9, the lowering of the platform 3 in position 3*b* simultaneously causes the lowering of the lever 26 and of the lever 16, releasing the door cavity 13, and unlocking the threshold member 5 with respect to the door 1.

The unlocking position of the lever 16 is depicted in broken lines in FIG. 8.

The device which has just been described functions as follows.

When the railway platform is at the level of the bottom of the door 1, the platform 3 remains in the position 3*a*, and the door opens, the threshold member 5 remaining fixed to this door.

When the railway platform is at a higher level, corresponding to the top of the steps 2, the platform 3 is folded downwards (position 3*b*) in order to be situated in the horizontal plane of the top of the steps 2.

When the platform 3 is in the folded down position 3*b*, this actuates the unlocking of the threshold member with respect to the door 1.

Because of this, when the door 1 opens, the threshold member 5 remains in place in the door opening and fills in the major part of the space lying between the adjacent edge of the platform 3 and the edge of the railway platform.

What is claimed is:

1. A railway vehicle door assembly, comprising: a door, and a door opening to which passengers gain access by a set of steps arranged inside a vehicle, this door being mounted so as to slide between a closed position and an open position, a platform being constructed and arranged to be articulated on an axis substantially perpendicular to the door and situated substantially in the horizontal plane of the top of the steps, said platform being able to be moved from a free retracted position, with respect to the horizontal plane, and a position of use, in which it is situated in the horizontal plane; a threshold member projecting outward with respect to an external face of the door in order to fill in at least part of a space lying between an edge of the platform, when it is in its position of use, and an edge of a railway platform, said threshold member constructed and arranged such that it can selectively be changed from a first condition, wherein said threshold member moves dependent with said door, to a second condition, wherein said door moves independently with respect to said threshold member, said door comprising a single leaf extending partly above and partly under said threshold member, and said assembly having means for controlling the changing from said first condition to or from said second condition, said means for controlling allowing said threshold member to remain in position between said edge of said platform and the railway platform when said door is slid from its closed position to its open position.

2. A door assembly according to claim 1, characterised in that the platform has means for locking and unlocking the threshold member, when it is in its position of use.

3. A door assembly according to claim 1, characterised in that the threshold member is partly embedded in a recess formed in the door.

4. A door assembly according to claim 1, characterised in that the threshold member is connected to the door by guidance means.

5. A door assembly according to claim 1, wherein said assembly further comprises means for supporting an end of the threshold member, when the door is open, constructed and arranged to be attached to said vehicle body in a position close to an edge of the door opening opposite to the direction of opening of the door.

6. A door assembly according to claim 5, characterised in that the means for supporting the end of the threshold member comprises rollers carried by the end of the threshold member and abutment surfaces receiving the rollers fixed to the vehicle body.

7. A door assembly according to claim 1, wherein said assembly further comprises means for guiding the movement of said threshold member independently of said door.

8. A door assembly according to claim 7, characterised in that said means for guiding said threshold member comprises:

a rail fixed to the threshold member extending in the longitudinal direction of the said threshold member and projecting from an end of this member in the direction of opening of the door, and a slide on which the rail slides, the slide being fixed to the vehicle and having a length at least equal to the length of the threshold member.

9. A door assembly according to claim 1, characterised in that guidance means between the threshold member and the door comprise:

a rail fixed to the door, extending in the longitudinal direction of the threshold member and projecting from an end of the door on the same side as the direction of the opening of the door with a length at least equal to the length of the threshold member, and a slide fixed to the threshold member on which the rail slides, the length of the slide being substantially identical to that of the rail when the door is closed.

10. A door assembly to claim 2, characterised in that means for unlocking of the threshold member, when the platform is in a position of use, comprise a surface fixed to a face of the platform directed towards the steps, said surface coming to actuate a lever rotatably fixed to the threshold member causing an unlocking of said threshold member.

11. A door assembly according to claim 1, characterised in that the platform has means for locking and unlocking the threshold member, thereby controlling the movement of said threshold member.

12. A door assembly according to claim 1, wherein said assembly further comprises means for supporting said threshold member, said means constructed and arranged to be affixed to an external surface of the vehicle.

13. A door assembly according to claim 12, wherein said means for supporting said threshold member comprises a rail, at least a portion of which being constructed and arranged to be attached to the exterior surface of the vehicle and a slide, slidably attached to said rail.

14. A door assembly according to claim 1, wherein said assembly further comprises means for supporting said platform along an edge adjacent said door, said means constructed and arranged to be affixed to an external surface of the vehicle.

15. A railway vehicle door assembly, comprising:

a door, and a door opening to which passengers gain access by a set of steps arranged inside a vehicle, this door being mounted so as to slide between a closed position and an open position, a platform being constructed and arranged to be articulated on an axis substantially perpendicular to the door and situated substantially in the horizontal plane of the top of the steps, said platform being able to be moved from a free retracted position with respect to the horizontal plane and a position of use in which it is situated in the horizontal plane;

a threshold member, partly embedded in a recess formed in said door, projecting outward with respect to an external face of the door in order to fill in at least part of a space lying between an edge of the platform, when it is in its position of use, and an edge of a railway platform, said threshold member constructed and arranged such that it can selectively be changed from a first condition, wherein said threshold member moves dependent with said door, to a second condition, wherein said door moves independently with respect to said threshold member, said door comprising a leaf, and an assembly having means for controlling the changing from said first condition to or from said second condition, said means for controlling allowing said threshold member to remain in position between said edge of said platform and the railway platform when said door is slid from its closed position to its open position.

16. A railway vehicle door assembly, comprising:

a door, and a door opening to which the passengers gain access by a set of steps arranged inside the vehicle, this door being mounted so as to slide between a closed position and an open position, a platform being constructed and arranged to be articulated on an axis substantially perpendicular to the door and situated substantially in the horizontal plane of the top of the steps, said platform being able to be moved from a free retracted position with respect to the horizontal plane and a position of use in which it is situated in the horizontal plane;

a threshold member projecting outward with respect to an external face of the door in order to fill in at least part of a space lying between an edge of the platform, when it is in its position of use, and an edge of a railway platform, said threshold member constructed and arranged such that it can selectively be changed from a first condition, wherein said threshold member moves dependent with said door, to a second condition, wherein said door moves independently with respect to said threshold member, said door comprising a leaf, and said assembly having means for controlling the changing from said first condition to or from said second condition, said means for controlling allowing said threshold member to remain in position between said edge of said platform and the railway platform when said door is slid from its closed position to its open position and having means for supporting an end of the threshold member, comprising, rollers carried by the said end of the threshold member and abutment surfaces receiving the said rollers fixed to the vehicle body.

17. A railway vehicle door assembly, comprising:

a door, and a door opening to which passengers gain access by a set of steps arranged inside a vehicle, this door being mounted so as to slide between a closed position and an open position, a platform being constructed and arranged to be articulated on an axis substantially perpendicular to the door and situated substantially in the horizontal plane of the top of the steps, said platform being able to be moved from a free retracted position with respect to the horizontal plane and a position of use in which it is situated in the horizontal plane;

a threshold member projecting outward with respect to an external face of the door in order to fill in at least part of a space lying between an edge of the platform, when it is in its position of use, and an edge of a railway platform, said threshold member constructed and arranged such that it can selectively be changed from a first condition, wherein said threshold member moves dependent with said door, to a second condition, wherein said door moves independently with respect to said threshold member, said door comprising a leaf, and said assembly having means for controlling the changing from said first condition to or from said second condition, said means for controlling allowing said threshold member to remain in position between said edge of said platform and the railway platform when said door is slid from its closed position to its open position, said assembly constructed and arranged with guidance means between said threshold member and said door, said guidance means including:

a rail, fixed to said threshold member, extending in the longitudinal direction of said threshold member and projecting from an end of said threshold member in the direction of opening of said door; and a slide on which said rail slides, said slide being affixed to a body of the vehicle and constructed and arranged having a length at least equal to the length of the threshold member.

* * * * *

UNITED STATES PATENT AND TRADEMARK OFFICE

CERTIFICATE OF CORRECTION

PATENT NO. : 6,401,629 B1
DATED : June 11, 2002
INVENTOR(S) : Damien Brunooghe

It is certified that error appears in the above-identified patent and that said Letters Patent is hereby corrected as shown below:

Column 7,
Line 17, thereof, delete “the”.
Line 18, thereof, delete “the” and insert therefor -- a --.

Column 8,
Line 42, thereof, delete “body” and insert therefor -- part --.

Signed and Sealed this

Twenty-second Day of October, 2002

*Attest:*

*Attesting Officer*

JAMES E. ROGAN
*Director of the United States Patent and Trademark Office*